US007694462B2

(12) United States Patent
O'Callaghan et al.

(10) Patent No.: US 7,694,462 B2
(45) Date of Patent: Apr. 13, 2010

(54) CONSTRUCTION INDUSTRY PODS

(75) Inventors: Patrick Donal O'Callaghan, Cork (IE); Eric Lisson, County Cork (IE)

(73) Assignee: Thin Floor Pods Limited, Carrigaline, Co. Cork (IE)

( * ) Notice: Subject to any disclaimer, the term of this patent is extended or adjusted under 35 U.S.C. 154(b) by 0 days.

(21) Appl. No.: 11/408,066

(22) Filed: Apr. 21, 2006

(65) Prior Publication Data

US 2006/0185266 A1 Aug. 24, 2006

Related U.S. Application Data

(63) Continuation of application No. PCT/IE2004/000148, filed on Oct. 22, 2004.

(30) Foreign Application Priority Data

Oct. 24, 2003 (IE) ..... 2003/0800

(51) Int. Cl.
*A47K 3/16* (2006.01)

(52) U.S. Cl. ..... 52/35; 52/34; 52/36.2; 52/79.12

(58) Field of Classification Search ..... 52/36.1, 52/36.2, 79.1, 34, 35, 79.5, 143, 79.12
See application file for complete search history.

(56) References Cited

U.S. PATENT DOCUMENTS 1,988,388 A * 1/1935 Mioton ..... 52/92.2
2,204,319 A * 6/1940 Parsons et al. ..... 446/112
2,712,863 A * 7/1955 Busch ..... 52/79.1
3,005,205 A * 10/1961 Breen ..... 4/300
3,601,521 A * 8/1971 Morton ..... 174/502
3,751,737 A * 8/1973 Mustee ..... 4/608
3,902,291 A * 9/1975 Zucht ..... 52/284
4,018,021 A * 4/1977 Dow ..... 52/251
4,221,441 A * 9/1980 Bain ..... 312/228
4,447,996 A * 5/1984 Maurer et al. ..... 52/79.1
4,470,227 A * 9/1984 Bigelow et al. ..... 52/79.1
4,667,580 A * 5/1987 Wetzel ..... 454/187
5,036,638 A * 8/1991 Kurtz, Jr. ..... 52/284
5,070,661 A * 12/1991 Lo Guidici ..... 52/79.1
5,365,013 A * 11/1994 Aulson ..... 588/249
5,567,335 A 10/1996 Baessler et al.
5,735,639 A * 4/1998 Payne et al. ..... 405/129.57
5,806,270 A * 9/1998 Solano et al. ..... 52/747.11
6,179,522 B1 * 1/2001 Sanford et al. ..... 405/129.55

(Continued)

FOREIGN PATENT DOCUMENTS

DE 9402979 4/1994

(Continued)

*Primary Examiner*—Richard E Chilcot, Jr.
*Assistant Examiner*—Chi Q Nguyen
(74) *Attorney, Agent, or Firm*—Jacobson Holman PLLC

(57) ABSTRACT

A pod comprises a box-section steel frame (1) having horizontal structural members (4, 11). A floor is provided by welding a 6 mm steel plate (10) to the horizontal structural members (4, 11). The plate (10) has a checkered pattern of 2 mm ridges on its lower surface. A combination of inherent stiffness of the plate material, the ridges (50) and welding to both edge (4) and internal (11) structural members achieves sufficient stiffness of the floor to allow it to be tiled off-site during manufacture because the floor is thin, there is no need for the builder to provide a recess in the concrete on-site.

16 Claims, 3 Drawing Sheets

U.S. PATENT DOCUMENTS

| | | | | |
|---|---|---|---|---|
| 6,354,058 | B1 * | 3/2002 | Lewis | 52/749.11 |
| 6,439,824 | B1 * | 8/2002 | Harris et al. | 414/416.03 |
| 6,442,905 | B1 * | 9/2002 | Weinstein | 52/34 |
| 6,457,277 | B1 * | 10/2002 | Meyers | 52/36.1 |

FOREIGN PATENT DOCUMENTS

| | | |
|---|---|---|
| DE | G 94 02 979.2 | 4/1994 |
| EP | 0159976 | 10/1985 |
| EP | 0546847 | 6/1993 |
| EP | 1070804 | 1/2001 |
| GB | 2084213 | 4/1982 |
| GB | 2244501 | 12/1991 |
| GB | 2266735 | 11/1993 |
| GB | 2266907 | 11/1993 |
| JP | 11-269953 | 10/1999 |
| WO | WO91/12386 | 8/1991 |

* cited by examiner

CONSTRUCTION INDUSTRY PODS

This is a continuation of PCT/IE2004/000148 filed 22 Oct. 2004 and published in English.

INTRODUCTION

1. Field of the Invention

The invention relates to construction industry pods which are self-contained rooms manufactured off-site, lifted into a building, and connected up to building services such as electricity, water, and gas supplies.

2. Prior Art Discussion

Pods have been used mainly for bathrooms, however, they are increasingly being used for other rooms such as kitchens and utility rooms.

The most common form of pod comprises a structural floor of plywood, cement board, and tiles on structural floor beams for example. This arrangement provides high strength and rigidity. This allows the manufacturer to completely furnish the pod with all contents such as basins and tiles at the off-site manufacturing plant. The builder simply inserts the pod in position, hooks up building services, and does not need to open it until the building is complete. At this stage there is little risk of damage to items such as tiles or mirrors. Because the builder only needs to hook up the services to the outside of the pod, on-site labour and management is dramatically reduced.

However, to ensure that the pod floor surface level is the same as that of the adjoining corridor or room it has been necessary to use shuttering when pouring the floor slab to provide a recess for the pod. This can be time-consuming and can lead to difficulties arising from the fact that the exact position of the pod must be determined at an early stage in a construction project. Another problem is that rainwater often accumulates in the recesses, giving rise to the task of pumping the water out.

These problems have existed for many years, and some architects and builders regard these disadvantages as outweighing the benefits of using pods.

The approach to addressing this problem has been to provide a floorless pod, in which the units are secured to vertical walls of the pod's frame. However, this means that the pod is not a complete module and work such as tiling must be done on-site after installation. This also gives rise to the possibility of damage to fittings such as bathroom sinks as access must be allowed within the pod during construction. Thus, to a large extent this approach defeats the purposes of using pods.

The invention addresses these problems.

SUMMARY OF THE INVENTION

According to the invention, there is provided a construction industry pod comprising a floor, walls, ceiling, and installed fittings, and connectors for connection to building services, wherein the floor comprises a thin plate secured to the frame.

In one embodiment, the floor comprises a metal plate secured to the frame.

In another embodiment, the plate is of mild steel.

In a further embodiment, the plate has a thickness in the range of 2 mm to 15 mm.

In one embodiment, the plate has a thickness of approximately 6 mm.

In another embodiment, the frame comprises horizontal structural members, and the plate is secured to said members.

In a further embodiment, the horizontal structural members comprise peripheral members at edges of the floor, and internal members.

In one embodiment, the internal members are cantilevered to the peripheral members.

In another embodiment, the internal members are welded to the peripheral members.

In a further embodiment, the floor plate is welded to the peripheral and internal structural members.

In one embodiment, the structural members are of box-section configuration.

In another embodiment, the internal members are hidden under units of the pod such as a bath, a shower tray, or a sink unit.

In a further embodiment, the floor further comprises a floor covering over the plate.

In one embodiment, the floor covering comprises tiles secured by adhesive to the plate and separated by grout.

In another embodiment, the adhesive has flexibility.

In a further embodiment, the grout has flexibility.

In one embodiment, the underside surface of the plate is exposed, and comprises protruding formations.

In another embodiment, the formations are ridges

In a further embodiment, the ridges are in a checkered pattern.

In one embodiment, the ridges have a depth of approximately a third of the total depth of the plate including the ridges.

In another embodiment, the plate has a total depth of 6 mm, of which the ridges have a depth of approximately 2 mm.

In another aspect, the invention provides a method of manufacturing a construction industry pod as defined above, the method comprising the steps of fabricating the frame, providing a metal plate, heating the metal plate, and welding the metal plate to the frame to provide the floor plate.

In one embodiment, the plate is heated by a burner.

In another embodiment, the method comprises the further steps of tiling the floor plate with combed application of adhesive in beads of 4 mm to 8 mm separated by gaps of 8 mm to 12 mm.

In a further embodiment, the plate comprises a plurality of small plates stitch welded together.

In a further aspect, the invention provides a method of installing a pod as defined above, comprising the step of applying a curable liquid between the pod and the ground so that the liquid fills gaps between the plate and the ground and cures to solidify.

In one embodiment, the liquid is expanding foam.

BRIEF DESCRIPTION OF THE DRAWINGS

The invention will be more clearly understood from the following description of some embodiments thereof, given by way of example only with reference to the accompanying drawings in which:—

DETAILED DESCRIPTION OF THE INVENTION

Figure 1:
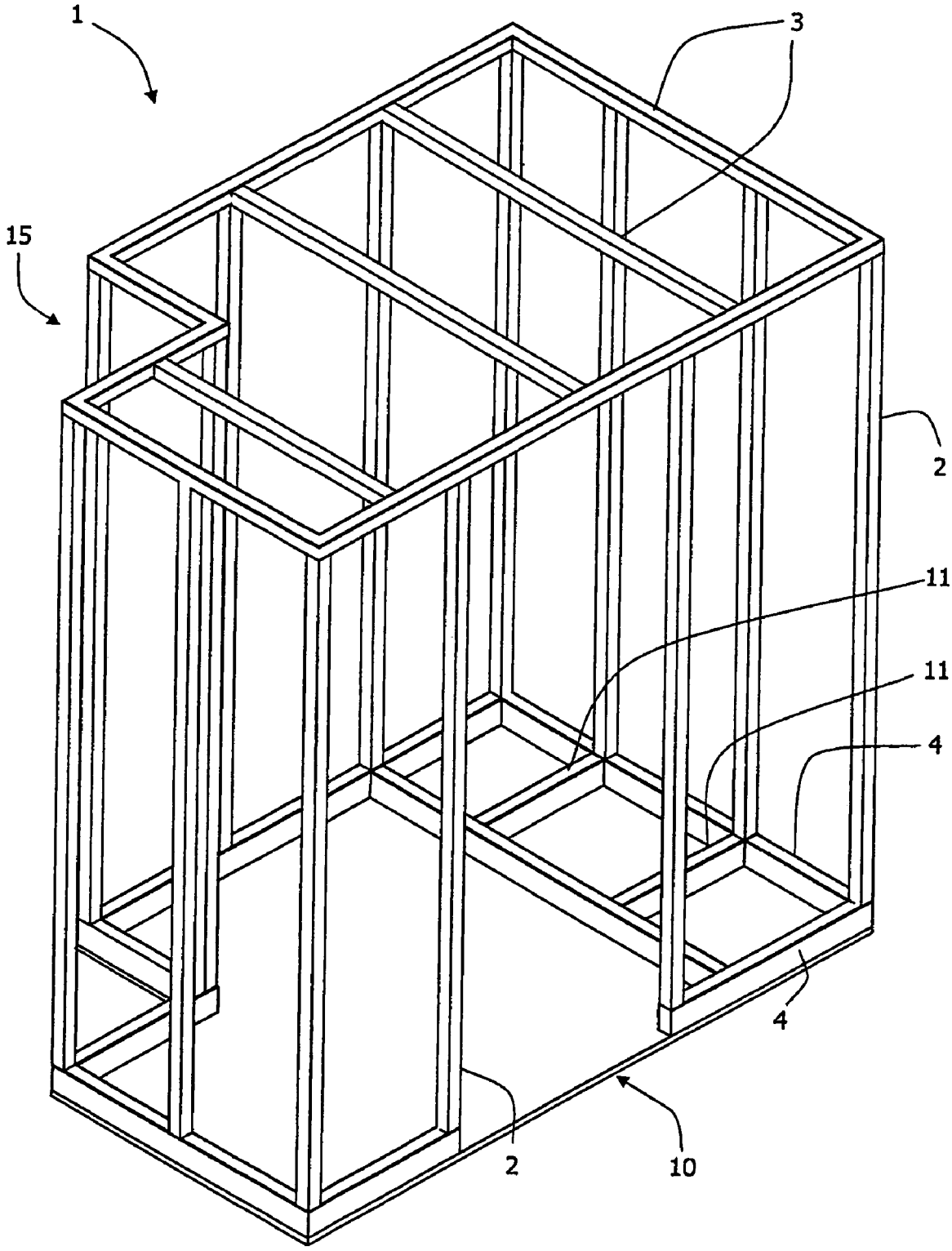
FIG. 1 is a perspective view of a partially-completed pod of the invention.

Referring to FIG. 1 a bathroom pod is manufactured by fabricating a steel frame 1. The frame 1 comprises box-section structural members including uprights 2, ceiling-level joists 3, horizontal edge members 4 extending around the floor boundary, and internal horizontal members 11 cantilevered to the edge members 4.

The various structural members form a frame defining a doorway, walls, ceiling and an external space 15 for connection to building plumbing and electrical services.

A floor 10 of thin steel plate is welded to the edge and internal floor-level structural members 4 and 11.

After fabrication of the frame, the floor plate 10 is welded to the members 4 and 11, and the walls and ceiling are completed using conventional construction methods such as use of plaster board and foam or wool insulation. Any units or fittings which can be wall mounted are installed, either before or after tiling according to the architect's specification. All services are terminated in the space 15 for "hooking up" to the building's services on-site.

Floor-mounted items such as a shower tray or bath are mounted on the internal floor sub-frame formed by the members 11. The floor is completed by tiling the plate 10, or applying a different floor covering.

Figure 2:
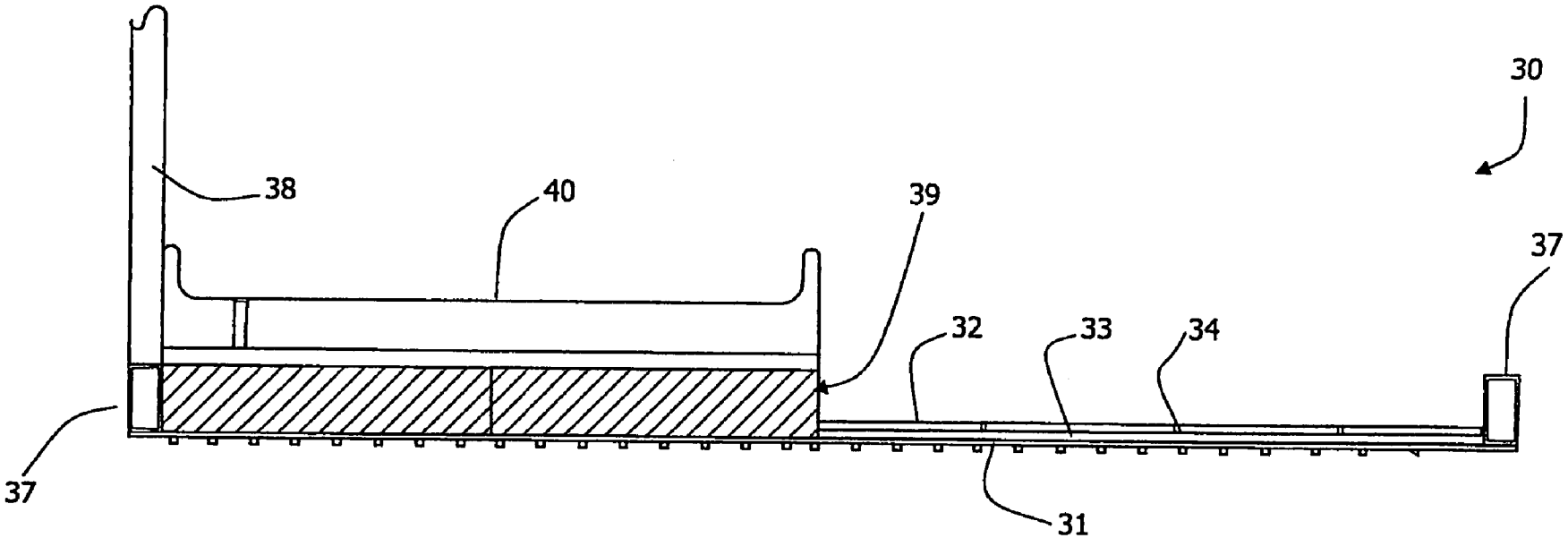
FIG. 2 is a cross-sectional view of a floor of a pod.
Figure 3:
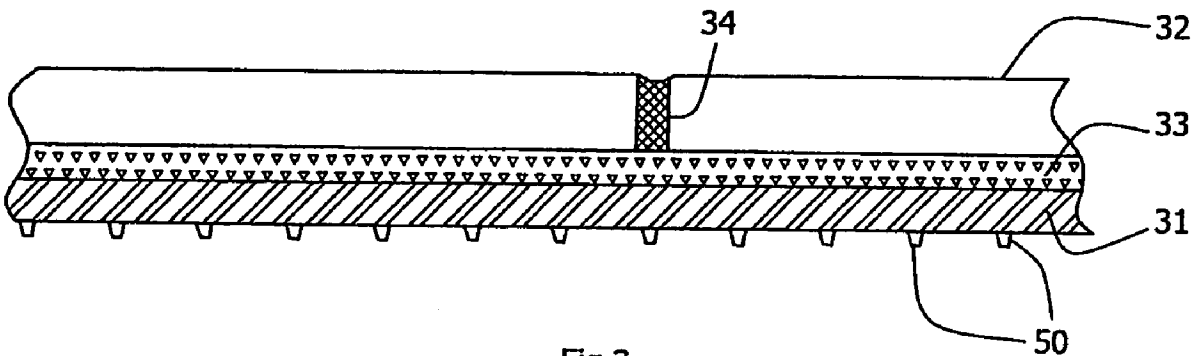
FIG. 3 is an expanded cross-sectional view of part of the pod.

Referring to FIGS. 2 and 3 a floor 30 for a pod is shown. The floor 30 comprises a steel plate 31 and tiles 32 placed on adhesive 33 and separated by grout 34.

The floor 30 also comprises edge members 37 and a floor-level sub-frame 39 cantilevered from the left hand edge member 37 as viewed in FIG. 2. A shower tray 40 is mounted on the sub-frame 39, the gaps between and above the members of the frame 39 allowing space for plumbing fittings. FIG. 2 also shows an upright 38 extending from the sub-frame 39.

The part of the floor 30 which is tiled is shown in more detail in FIG. 3. The steel plate 31 is of mild steel of 4 mm thickness and having a checkered pattern of ridges 50 of 2 mm depth on its lower surface. The adhesive 33 is an elastic two-part epoxy applied by combing to provide beads 6 mm wide separated by 10 mm gaps. These dimensions are more generally in the range of:

bead width, 4 mm to 8 mm, and gap, 8 mm to 12 mm.

The grout is also flexible, and this may be achieved for example by use of a latex additive.

Because the floor 30 is very thin, there is no need to provide a recess in the ground for the pod to reside in. However the floor is sufficiently strong to allow the floor internal covering to be completed so that the pod can be sealed until construction is complete.

Flexing of the floor during transport is minimised by virtue of the strength provided by the sub-frame 39 cantilevered to the edge frame members 37. Stiffness is also achieved by virtue of the ridges 50 on the underside of the plate 31. The pattern of 2 mm deep ridges adds considerably to the plate's stiffness. Furthermore, any small extent of flexing which does occur is unlikely to result in tiles popping up or cracking due to the flexible nature of the adhesive and grout.

Another advantage which stems from the ridges 50 is that when the pod is in-situ, the problem of water being drawn by capillary action into a very small gap between a flat plate surface and concrete ground is avoided. Furthermore, the builder can apply expanding foam underneath the pod. The foam expands out and fills gaps between the ridges, thus achieving uniform contact with the ground and avoiding hollow sounds when a person walks in the pod in use.

It will thus be appreciated that the invention achieves a complete room which can be sealed off-site and placed on a flat concrete base. This is of enormous benefit to the builder. Also, the risk of excessive flexure of the floor is avoided by the strength of the floor plate itself and support from the floor-level sub-frame. Risk of damage from any flexing which does occur is minimised because of the adhesive and grout used. The pattern on the underside of the floor plate provides not only rigidity, but also for excellent uniformity in ground contact, and avoidance of moisture penetrating under the floor.

Figure 4:
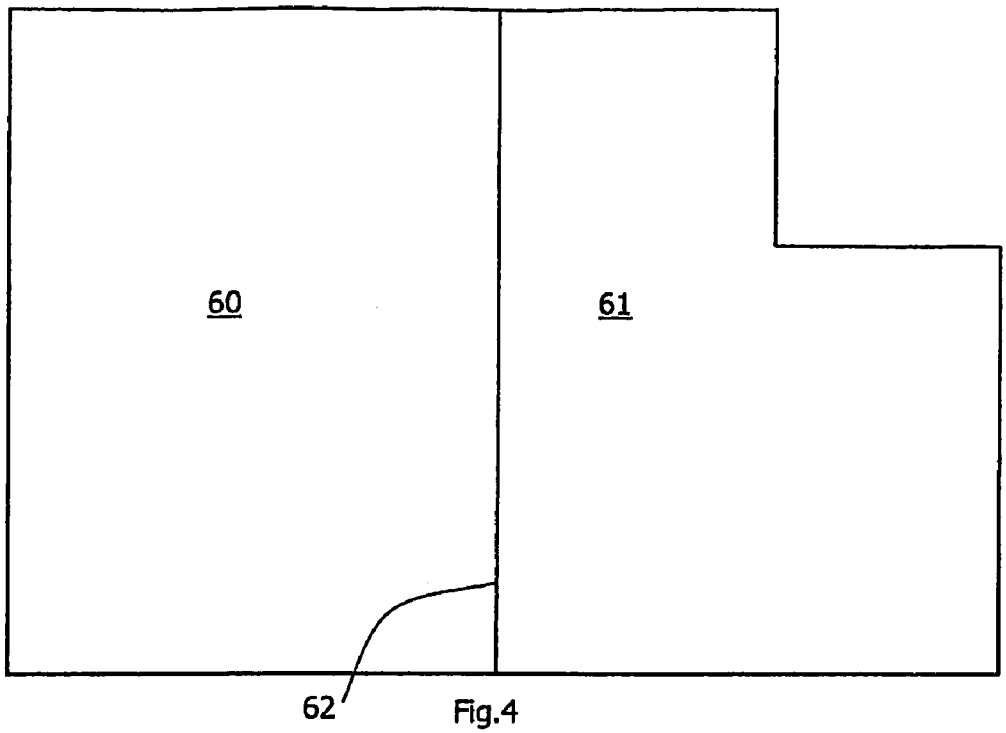
FIGS. 4 to 6 inclusive are diagrams illustrating stages of manufacturing the pod.
Figure 5:
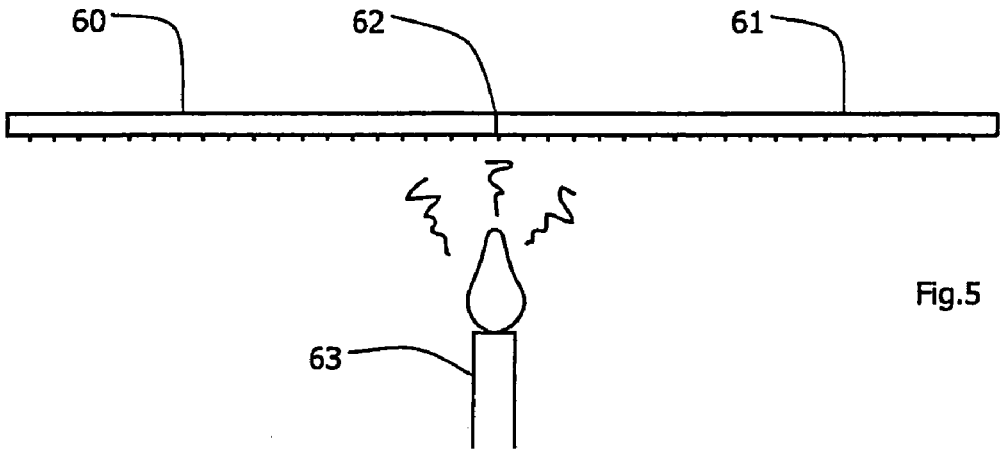
Figure 6:
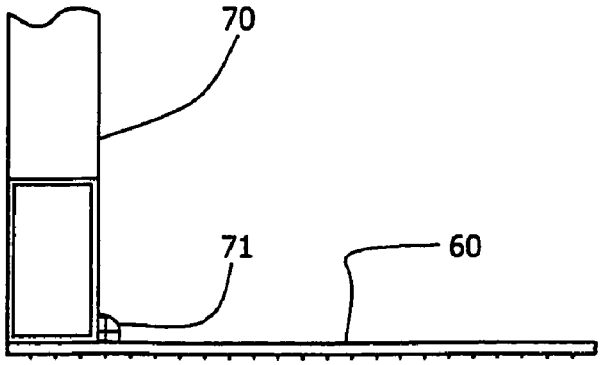

Referring to FIGS. 4 to 6 the manner in which the floor is manufactured is now described. Steel plates 60 and 60 of the type described above are butted together and stitch welded to form a stitch weld joint 62, so that the joint has high strength both at the top and bottom. The joined plates 60 and 61 are then gently and uniformly heated to a temperature in excess of 50° C. by a burner 63 to pre-stress them. While they are still heated, the plates 60 and 61 are welded to the underside of the structural frame, using weld joints such as the joint 71 to the structural members 70. The joined plates 60 and 61 then contract slightly, and so buckling of the floor after welding to the frame is avoided. This is another feature to ensure that the floor remains flat. Of course, there is no need to weld plates together if an available plate is large enough to cover the full floor area In this case, the above steps of heating before welding apply equally.

The invention is not limited to the embodiments described but may be varied in construction and detail. For example, while the plate has a thickness of 6 mm, this may be up to 15 mm, depending on the application.

The invention claimed is:

1. A construction industry pod comprising:

a frame, a floor, walls including vertically extending metal uprights, and a ceiling, the frame including horizontal structural members, the horizontal structural members being one or more metal peripheral members forming an edge of the frame and one or more metal internal members, at least one of the metal internal members being welded to at least one of the metal peripheral members, the floor being a thin metal plate welded to the metal peripheral members and the metal internal structural members and to an underside of the horizontal structural members of the frame, each internal member being covered and hidden from view under a bathroom fixture.

2. The construction industry pod as claimed in claim 1, wherein the plate is made of mild steel.

3. The construction industry pod as claimed in claim 1, wherein the plate has a thickness in a range of 2 mm to 15 mm.

4. The construction industry pod as claimed in claim 3, wherein the plate has a thickness of approximately 6 mm.

5. The construction industry pod as claimed in claim 1, wherein the plate is secured to said horizontal structural members and the peripheral members are located at edges of the floor.

6. The construction industry pod as claimed in claim 1, wherein the plate is secured to said horizontal structural members and the horizontal structural members are of box-section configuration.

7. The construction industry pod as claimed in claim 1, wherein the floor further comprises a floor covering over the plate.

8. The construction industry pod as claimed in claim 1, wherein the floor further comprises a floor covering over the plate and the floor covering comprises tiles secured by adhesive to the plate and separated by grout.

9. The construction industry pod as claimed in claim 8, wherein the adhesive has flexibility.

10. The construction industry pod as claimed in claim 8, wherein the grout has flexibility.

11. The construction industry pod as claimed in claim 1, wherein the underside surface of the plate is exposed, and comprises protruding formations.

12. The construction industry pod as claimed in claim 11, wherein the formations are ridges.

13. The construction industry pod as claimed in claim 11, wherein the formations are ridges are in a checkered pattern.

14. The construction industry pod as claimed in claim 11, wherein the formations are ridges having a depth of approximately a third of the total depth of the plate including the ridges.

15. The construction industry pod as claimed in claim 14, wherein the plate has a total depth of 6 mm, of which the ridges have a depth of 2 mm.

16. A construction industry pod comprising a frame, a floor, walls including vertically extending metal uprights, and a ceiling, the floor being a thin metal plate welded to the frame, an underside of the thin metal plate being exposed for ground contact on a concrete base, and the floor further including a floor covering on the thin metal plate, the frame including horizontal structural members and the thin metal plate being welded to said members, the horizontal structural members including one or more peripheral metal members at edges of the floor, and one or more metal internal members, at least one metal internal member being welded to a peripheral metal member, the floor being welded to an underside of the horizontal members of the frame, each internal member being covered and hidden from view under a bathroom fixture.

* * * * *